US008925250B2

(12) United States Patent
Parker

(10) Patent No.: US 8,925,250 B2
(45) Date of Patent: Jan. 6, 2015

(54) AUTOMATIC DOOR BOTTOM DROP-DOWN SEAL

(75) Inventor: Ronald Brian Parker, Hayling Island (GB)

(73) Assignee: RBP Associates Limited, Hayling Island (GB)

( * ) Notice: Subject to any disclaimer, the term of this patent is extended or adjusted under 35 U.S.C. 154(b) by 0 days.

(21) Appl. No.: 13/821,367

(22) PCT Filed: Sep. 7, 2011

(86) PCT No.: PCT/GB2011/001316

§ 371 (c)(1),
(2), (4) Date: May 14, 2013

(87) PCT Pub. No.: WO2012/032295

PCT Pub. Date: Mar. 15, 2012

(65) Prior Publication Data

US 2013/0219792 A1 Aug. 29, 2013

(30) Foreign Application Priority Data

Sep. 7, 2010 (GB) ..... 1014833.6

(51) Int. Cl.
*E06B 7/20* (2006.01)
*E06B 7/21* (2006.01)
*E06B 7/215* (2006.01)

(52) U.S. Cl.
CPC ... *E06B 7/20* (2013.01); *E06B 7/21* (2013.01); *E06B 7/215* (2013.01)
USPC ..... 49/310; 49/308; 49/306

(58) Field of Classification Search
USPC ..... 49/303, 304, 305, 306, 307, 308, 310
See application file for complete search history.

(56) References Cited

U.S. PATENT DOCUMENTS

| | | | | | |
|---|---|---|---|---|---|
| 1,682,389 | A | * | 8/1928 | Ludeke | 49/308 |
| 1,709,419 | A | | 4/1929 | Sward | |
| 1,948,108 | A | * | 2/1934 | Goellner | 49/307 |
| 2,066,188 | A | * | 12/1936 | Reese | 49/307 |
| 2,282,019 | A | * | 5/1942 | Balousek | 49/307 |

(Continued)

FOREIGN PATENT DOCUMENTS

| | | | | |
|---|---|---|---|---|
| CH | 666719 A5 | * | 8/1988 | E06B 7/20 |
| DE | 3109105 A1 | | 9/1982 | |

(Continued)

OTHER PUBLICATIONS

International Search Report dated Dec. 16, 2011 for corresponding International Application No. PCT/GB2011/001316, filed Sep. 7, 2011.

(Continued)

*Primary Examiner* — Jerry Redman
(74) *Attorney, Agent, or Firm* — David D. Brush; Westman, Champlin & Koehler, P.A.

(57) ABSTRACT

An automatic door bottom drop down seal having an actuator responsive to closing of the door for moving a sealing member vertically downwards into a sealing position relative to the door threshold when the door is closed. The actuator includes a arm connected to a block slidable within a channel of the seal housing. The arm is pivotally connected to the slide block so to pivot downwardly to impart downward pressure on the sealing member.

10 Claims, 4 Drawing Sheets

(56) References Cited

U.S. PATENT DOCUMENTS

| | | | | | |
|---|---|---|---|---|---|
| 2,344,278 | A | * | 3/1944 | Balousek | 49/307 |
| 2,820,261 | A | * | 1/1958 | Brown | 49/306 |
| 3,030,674 | A | * | 4/1962 | Kapaun et al. | 49/309 |
| 3,072,977 | A | * | 1/1963 | Burda | 49/307 |
| 3,199,155 | A | | 8/1965 | Coleman | |
| 3,703,788 | A | * | 11/1972 | Rivers | 49/307 |
| 3,704,547 | A | * | 12/1972 | Hansen et al. | 49/308 |
| 4,089,136 | A | * | 5/1978 | Lapinski et al. | 49/308 |
| 4,406,088 | A | | 9/1983 | Berndt, Jr. | |
| 4,425,738 | A | * | 1/1984 | Christensen | 49/310 |
| 4,519,165 | A | * | 5/1985 | Cronenberg et al. | 49/307 |
| 4,805,345 | A | * | 2/1989 | Ohi | 49/308 |
| 4,947,584 | A | * | 8/1990 | Wexler | 49/307 |
| 5,454,192 | A | * | 10/1995 | Adler et al. | 49/307 |
| 5,522,180 | A | * | 6/1996 | Adler et al. | 49/309 |
| 5,642,588 | A | * | 7/1997 | Sowers | 49/307 |
| 6,082,047 | A | * | 7/2000 | Comaglio et al. | 49/308 |
| 6,125,584 | A | * | 10/2000 | Sanders | 49/312 |
| 6,195,939 | B1 | | 3/2001 | Sowers | |
| 6,332,294 | B1 | * | 12/2001 | Carranza | 52/204.1 |
| 7,260,915 | B2 | * | 8/2007 | Cronenberg et al. | 49/308 |
| 2004/0010973 | A1 | * | 1/2004 | Lio et al. | 49/306 |
| 2009/0077895 | A1 | | 3/2009 | Tshai | |

FOREIGN PATENT DOCUMENTS

| | | | | | |
|---|---|---|---|---|---|
| DE | 3124106 | A1 | * | 12/1982 | E06B 7/21 |
| DE | 3526720 | A1 | * | 1/1986 | E06B 7/20 |
| EP | 0844359 | A2 | | 5/1998 | |
| EP | 1450002 | A1 | | 8/2004 | |

OTHER PUBLICATIONS

Written Opinion dated Dec. 16, 2011 for corresponding International Application No. PCT/GB2011/001316, filed Sep. 7, 2011.

* cited by examiner

AUTOMATIC DOOR BOTTOM DROP-DOWN SEAL

CROSS-REFERENCE TO RELATED APPLICATIONS

This Application is a Section 371 National Stage Application of International Application No. PCT/GB2011/001316, filed Sep. 7, 2011, which is incorporated by reference in its entirety and published as WO 2012/032295 on Mar. 15, 2012, not in English.

STATEMENT REGARDING FEDERALLY SPONSORED RESEARCH OR DEVELOPMENT

None.

THE NAMES OF PARTIES TO A JOINT RESEARCH AGREEMENT

None.

FIELD OF THE DISCLOSURE

The present disclosure relates to an automatic door bottom drop-down seal. More especially, the disclosure relates to a sealing mechanism that imparts a downward force on the seal and which is resistant to upward pressure during use.

BACKGROUND OF THE DISCLOSURE

Automatic door bottom seals are known. A very successful automatic door bottom drop-down seal is disclosed in U.S. Pat. No. 6,125,584.

One disadvantage of the seal mechanism described in U.S. Pat. No. 6,125,584 is that downward pressure is not exerted and maintained on the seal during use to push and hold the seal against the floor. Rather, the H-shaped housing is lowered via bending of flat leaf springs which have little resistance to upward pressure.

In use the H-shaped housing drops down to rest against the floor to form a seal which may be fairly efficient in terms of a draft barrier but has little or no acoustic properties. Moreover, when a number of seal sections extend across an uneven floor, gaps between the floor and the bottom of the seal will inevitably form at various points along the length of the door.

US 2009/0077895 discloses a drop-down seal with a handle which is turned to hold the seal housing down against the floor. The use of a handle is, however, cumbersome and is undesirable to the user who generally would not wish to bend down and turn a handle located at the bottom of a drop every time the door is shut.

SUMMARY

According to one aspect of an exemplary embodiment of the invention, there is provided a drop-down seal for a hinged door which is pivotable over a door threshold when closed, the door bottom comprising:

- a sealing member having a length corresponding to the width of the door bottom;
- an actuator responsive to closing of the door for moving said sealing member vertically downwardly into a sealing position relative to the door threshold when the door is closed;
- the actuator comprising a plurality of elements located within a channel positionable adjacent the bottom of the door, the elements comprising at least one slide blocks slidable along the channel and having a pivotible arm, one end of which is connected to the underside of the block via a C-shaped channel and the other end of which is connected to the sealing member, the arm being pivotable as the block slides along the channel to a position whereby the arm extends downwardly between the block and the sealing member thereby to impart and maintain downward pressure on the sealing member during use.

Preferably channel is formed within an elongated inverted U-shaped housing.

BRIEF DESCRIPTION OF THE DRAWINGS

Embodiments of the invention will now be described with reference to the accompanying figures in which.

DETAILED DESCRIPTION OF ILLUSTRATIVE EMBODIMENTS

The main elements of a drop-down seal are shown in the prior art (and particularly that identified in the aforementioned description).

The foregoing description will only discuss the improvements to such systems.

Figure 1:
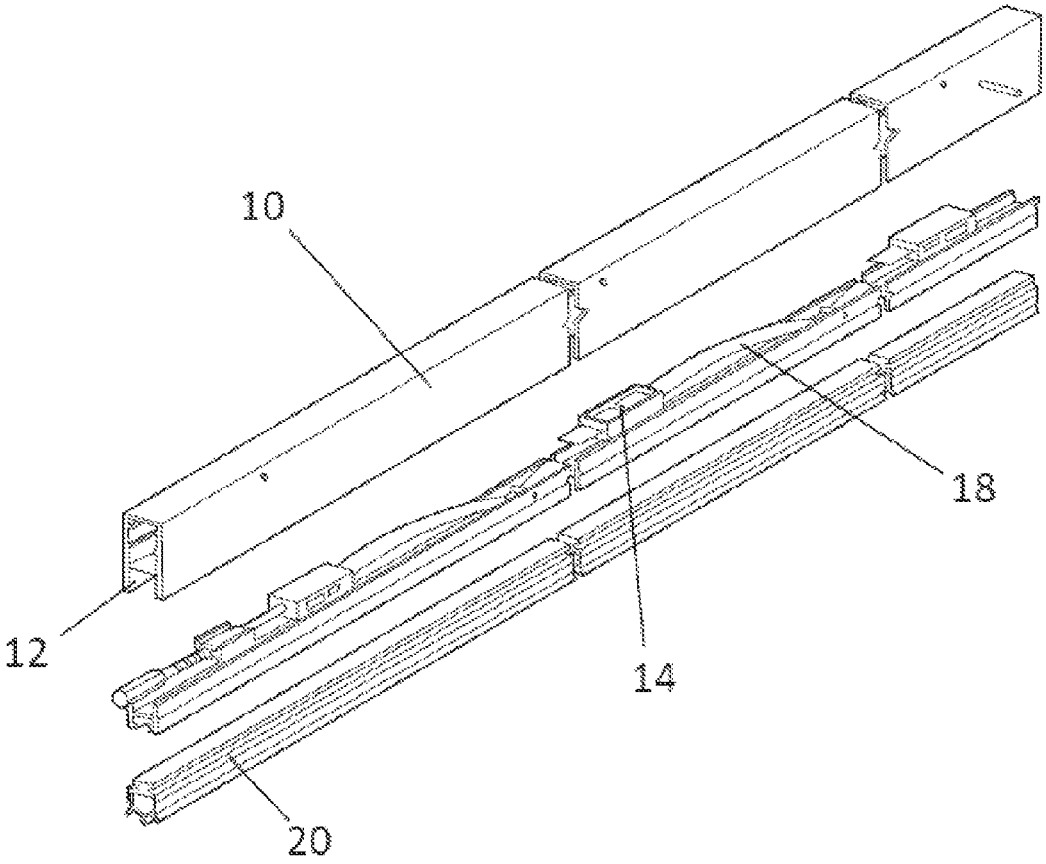
Fig. 1 PRIOR ART
FIG. 1 is a perspective detail view of a prior art drop down seal.

FIG. 1 shows a prior art automatic door bottom drop-down seal mechanism. The mechanism comprises a main elongated inverted U-shaped housing 10 for attachment to the bottom of a door. Within the housing 10 is located a channel 12 having interconnected sliding and fixed blocks 14, 16 with flat leaf spring members 18 which are fixedly attached to the one slide block and one fixed block. By "slide block" it is meant a block that is slidable within the channel 12. The slide blocks 14 slide along the channel causing the flat leaf spring members 18 to bend downwardly to push down the sealing element 20.

Figure 2:
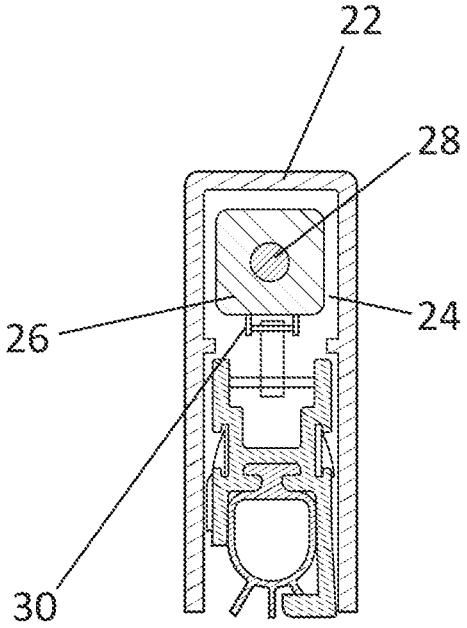
FIG. 2 is cross-sectional view, taken along line A-A of FIG. 5, of a drop down seal constructed in accordance with an embodiment of the present invention prior to use while the door is open.
Figure 3:
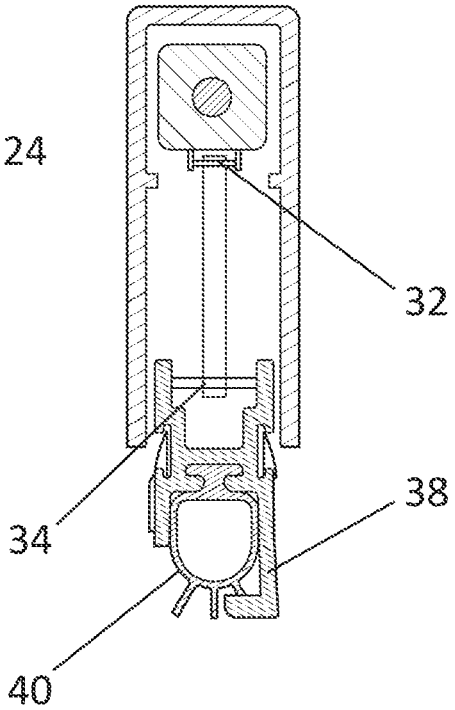
FIG. 3 is a cross-sectional view, taken along line A-A of FIG. 5, of the drop down seal of FIG. 2 when the door is closed.

FIGS. 2 and 3 show an end cross section of a seal assembly constructed in accordance with an embodiment of the invention. The seal mechanism comprises a main housing 22 which is located on the bottom of a door (not shown) or which may be located within a recess formed in the bottom of a door. The main housing 22 may alternatively be fixed to the back of the door bottom.

The housing 22 is formed as an inverted U-shaped section and defines a longitudinal channel 24.

A first slide block 26 is located at one end of the housing 10. The block 26 is connected to an actuator button 28 which activates when the door closes, to slide the block 26 along the channel 24.

A C-shaped bracket 30 is secured to the underside of the slide block 26.

Each arm of the bracket 30 has an aperture located at the front section of the bracket 30 to receive a pin 32 so to extend across the two arms.

An arm 34 is connected to the bracket 30 and has an aperture through which the pin 32 passes, through such that the arm 34 is pivotable about the pin 32 with the pivot centre point being forward of the leading vertical edge of the block 26. The other end of the arm 34 is secured in the same or a similar manner to a sealing element 36. FIG. 2 shows the sealing element 36 in the closed position within the housing 22.

The sealing element 36 comprises an elongated blade 38 carrying a rubber seal 40.

The sealing element 36 may be of any alternate shape. In an alternative embodiment the blade 38 is not be present.

Depression of the actuator button 28, which is initiated on closure of the door, causes the arm 34 to pivot downwardly in respect of the bracket 30 which in turn imparts downward movement on the sealing element 36 (as can be seen in FIG. 3).

Figure 4:
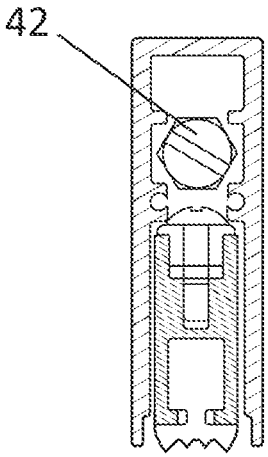
FIG. 4 is a cross-sectional view, taken along line A-A of FIG. 6, of a drop-down seal prior to the door being closed constructed in accordance with a further embodiment present invention.

In the embodiment shown in FIG. 4, the slide block 26 is connected to the actuator button 28 via an adjustable screw 42.

Figure 5:
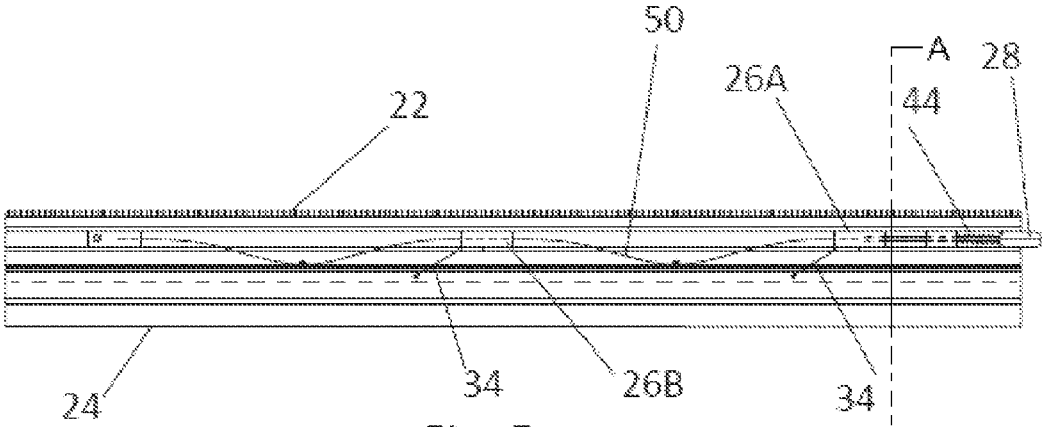
FIGS. 5 and 6 are internal, side views of the drop-down seal in use.
Figure 6:
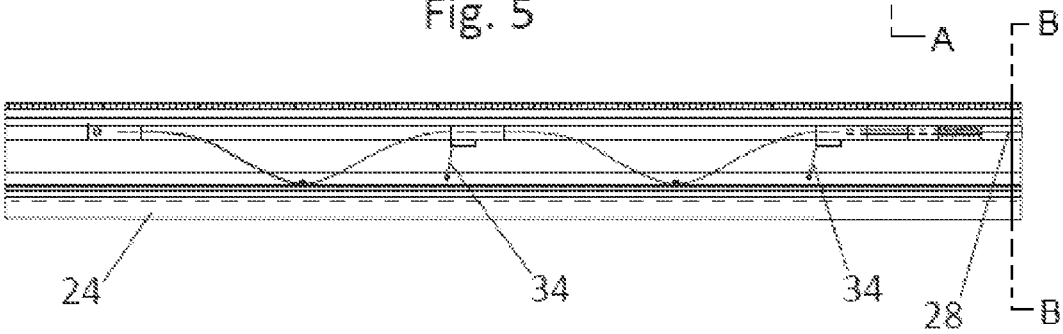

Referring now to FIGS. 5 and 6, the slide block 26 is also attached to a coiled spring mechanism 44 and a connecting metal rod 46. Depression of the actuator button 28 (which happens automatically as the door is closed), pushes the slide block 26 and the connecting rod 46 along the channel 24.

Horizontal movement of the slide block 26 imparts downward pressure on the blade 38 due to pivoting movement the arm 34. As the slide block 26 slides along the channel 24 the sides of the bracket 30 connecting the pins 32 form and act as bushes to pivot the arm 34 downwardly to an almost vertical position.

As the sealing element 36 remains fixed in relation to the longitudinal axis of the housing 22, pivoting of the arm 34 to a substantially vertical orientation causes a direct downward pressure to be exerted on the sealing element 36 causing it to be downwardly displaced from the housing 10 thereby pushing the sealing element (comprising the aluminium blade 38 and the rubber seal 40) against the floor to provide a strong acoustic seal across the entire sealing element 36.

The arm 34 is sized slightly less than the internal dimension of the channel 24 within the housing 22. Preferably the length of the arm is calculated to be equivalent to the third, i.e. the longest side, of a pythagorean triangle, where both the height and length dimensions are of equal length.

Each slide block 26 within the channel 24 has an associated arm and connecting rigid rod 46. The rods 46 can be daisy chained throughout the entire length of the seal mechanism.

It is common have four block elements within a drop-down seal mechanism. The sliding mechanism is adjustable such that the vertical travel distance of the sealing 36 element can be adjusted.

The first and third blocks 26A, 26B are slidable along the channel, and have pivotable arms 34 as detailed, and are connected together via rods (not shown) such that movement of the first block 26A will, in turn, impart movement onto the third block 26B.

The other two blocks 48 are fixed in position. Flat leaf spring members 50 which are fixedly attached to the first and third blocks 26A, 26B, for example, extend between each pair of the blocks 26. The fixed blocks 48 cause flat leaf spring members 50 to bend downwardly but will not impart downward movement on the sealing member 38. The flat leaf spring members 50 have a dimpled central section to enable them to be flexibly attached to the sealing mechanism 38.

The downward movement of the arm 34 controls the flat leaf spring members 50 to create a downward force greater than the flat leaf spring members 50 would normally offer and then to retain the force to keep the sealing element 36 in position. The flat leaf spring members 50 assists in returning the mechanism to rest when the door is opened.

In an alternative embodiment (not shown), the first and third blocks are still slidable and second and fourth blocks remain fixed within the channel.

In this embodiment, further rod(s) extend from the first block to and beyond the fourth block. One end of the rod is secured to first block by mechanical means. The rod passes through central longitudinal holes or channels formed in the second, third and fourth blocks. Coiled springs are provided between each adjacent block. The rod is also threaded through each spring.

Under pressure the springs in the rod mechanism between the first and second blocks and the third and fourth blocks are compressed and bend horizontally reserving the force to enable the bottom blade with the seal rubber to rise back up. When the motion stops due to the button being fully depressed, the blade exerts a downward pressure on the floor/threshold surface and compresses the rubber seal against the surface forming a seal. When the button is released i.e. the door is opened the springs retract, everything returns back to the horizontal position followed by the arm(s). The blade fully retracts ready for use again.

Figure 7:
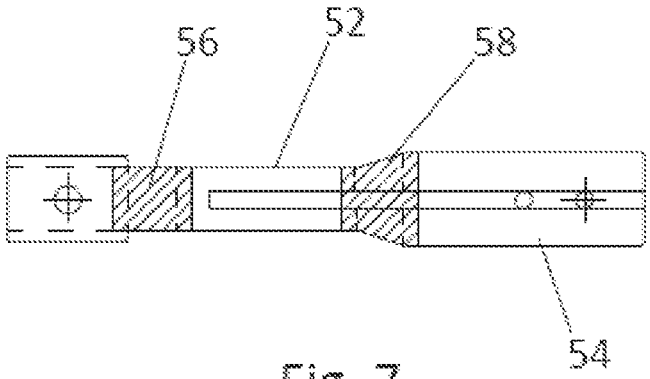
FIGS. 7 and 8 are plan and side section views respectively of an arm forming part of a drop-down seal constructed in accordance with a further embodiment of the invention.
Figure 8:
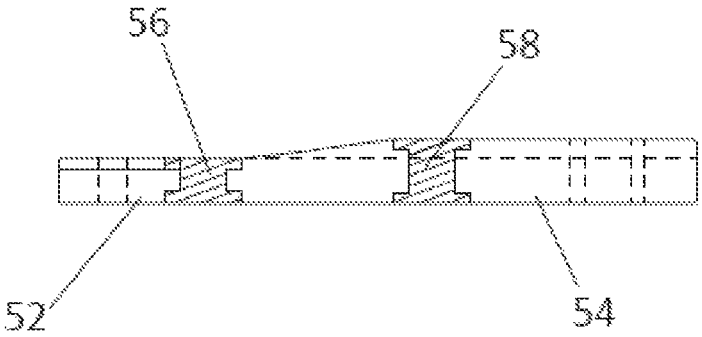

FIGS. 7 and 8 illustrate a polypropylene arm forming part of a further embodiment of the invention. In this embodiment the bracket, pin and arm arrangement is replaced by a synthetic material assembly. The synthetic material may be polypropylene or similar material.

The slide block 26 of the embodiments described above is replaced by a polypropylene arm comprising having two sections 52, 54 separated by flexible Thermo Plastic Elastamer (TPE) joints 56, 58. The arm could be made from other synthetic plastic material.

The arm assembly can be injection moulded as a single piece assembly. The TPE joint connections allow the arms sections to bend while being extremely robust, making them very difficult to tear or rip. The arm assembly provides greater flexibility allowing the downward pressure of the sealing element 36 to compensate for uneven floors up to 6 mm to 7 mm. If compression of one arm section is halted, the other arm section can still be compressed to allow that arm to reach its desire depth. The flexible TPE joints allow the arm assembly to compress and stretch to allow for uneven floor conditions.

The upper section of a synthetic plastic material arm assembly is formed as an inverted U-shaped section.

The upper part of this extruded moulded arm assembly replaces the slide block 26 and has a pivot centre point in front of the leading edge of an H-shaped bracket.

The assembly has a robust moulded joint continuous with the synthetic material block located at the front section of the assembly to allow the arm section to bend downwards.

The lower end of the arm (arm 26 above) is secured in the same or a similar manner to a horizontal block section which is secured to the sealing element 36 by a screw mechanism with the sealing element 36 in the closed position.

The overall performance of the automatic drop down door bottom seal system is enhanced by the above device as follows:

i) A door is channelled out and the device inserted as normal or can be mounted on the back of the door bottom;

ii) The button presses against the door frame when the door closes;

iii) The button slides gradually horizontally along the holding channel pushing the first and third block with it;

iv) Under this pressure the control of the arms the flat leaf springs in the mechanism deflect downwards forcing the bottom blade with the seal rubber in it to drop down;

v) The arms control the sealing member movement moving from approximately 45° to substantially vertical;

vi) In the assembled condition the drop bar sealing element rests entirely in the U-shaped channel element;

vii) The arms creates an additional, sustainable and equal downward force far greater than the unmodified device can ever exert. This enables the rubber seal to crush against the receiving surface evenly and this pressure to be maintained for as long as the door remains closed i.e. the button under pressure. Different rubber seals can be used to enhance the overall performance and be used for different applications. These can range from soft rubbers to harder rubber seals some having deeper formations to form the seal elements;

viii) The downward force exerted by the arms enhances the performance significantly and can upgrade acoustic, energy conservation and dust protection properties of the existing automatic drop down door bottom seal devises;

ix) When the actuator button is released i.e. the door is opened the flat leaf springs assist to retract everything back to the horizontal position followed by the arms. The blade fully retracts ready for use again;

x) The arms give the seal a unique feature which enables the sealing element to be self levelling sealing against uneven and or sloping door threshold arrangements.

An exemplary embodiment of the present invention seeks to provide an improvement to the aforementioned automatic door bottom drop-down seal by providing a mechanism to impart a continual downward pressure on the seal housing during use to retain the seal firmly against the floor in use.

It will be appreciated that the foregoing are merely an examples of embodiments and just some examples of their use. The skilled reader will readily understand that modifications can be made thereto without departing from the true scope of the inventions.

The invention claimed is:

1. A drop-down door seal for a hinged door which is pivotable over a door threshold when closed, the door having a door bottom and the drop-down door seal comprising:

an elongate housing formed with a channel which is open along a lower side of the channel;

a sealing member positioned in the channel and having a length corresponding to the that of the door bottom; and an actuator responsive to closing of the door and configured to move automatically said sealing member vertically downwardly into a sealing position relative to the door threshold when the door is closed the actuator comprising a plurality of elements located within the channel, the elements comprising:

at least one fixed block fixed at a location within the channel;

at least one slide block slidable along the channel;

at least one, respective leaf spring secured between opposed ends of each pair of slide and fixed blocks and to the sealing member; and a pivotible arm, one end of which is connected to an underside of the slide block and another end of which is connected to the sealing member at a position forward of a leading edge of the slide block and between points of contact of each leaf spring and the sealing member, the arm being pivotable in a direction toward the sealing member and the leaf spring being configured to flex downwardly such that the arm and leaf spring simultaneously impart a combined downward force on the sealing member as the slide block slides along the channel, wherein a distance between each pair of slide and fixed blocks is reduced through movement of each slide block within the channel caused by automatic activation of the actuator.

2. The drop-down door seal according to claim 1, wherein the arm is connected to a C-shaped bracket secured to an underside of the slide block.

3. The drop-down door seal according to claim 1, wherein the sealing member comprises an elongate blade and a seal.

4. The drop-down door seal according to claim 3, wherein the blade is made from aluminium.

5. The drop-down door seal according to claim 3 wherein the seal is made from rubber.

6. The drop-down door seal according to claim 1, the actuator further comprising an actuator button that is depressed through action of closing the door, the button, once depressed causing slidable movement of the slide block within the channel.

7. The drop-down door seal according to claim 1, wherein the channel elements comprise two slide blocks and two fixed blocks.

8. The drop-down door seal according to claim 1, wherein the arm is made from synthetic plastic material.

9. The drop-down door seal according to claim 8, wherein the arm comprises two sections divided by a flexible joint.

10. The drop-down door seal according to claim 9, wherein the joint is constructed from thermo plastic elastomer.

* * * * *

UNITED STATES PATENT AND TRADEMARK OFFICE

CERTIFICATE OF CORRECTION

PATENT NO. : 8,925,250 B2
APPLICATION NO. : 13/821367
DATED : January 6, 2015
INVENTOR(S) : Ronald Brian Parker It is certified that error appears in the above-identified patent and that said Letters Patent is hereby corrected as shown below:

On the title page

Item 57 in the Abstract, line 5, delete “a arm” and insert therefor --an arm--.

In the claims

In claim 1, column 5, line 51, after “corresponding to”, delete “the”.

Signed and Sealed this
Third Day of May, 2016

Michelle K. Lee

Michelle K. Lee
*Director of the United States Patent and Trademark Office*